United States Patent [19]

Granot et al.

[11] Patent Number: 4,703,926

[45] Date of Patent: Nov. 3, 1987

[54] SHEET FEEDING APPARATUS INCLUDING AN EDGE-ALIGNING DEVICE

[75] Inventors: Daniel Granot; Rami Servi, both of Haifa; Ehud Armoza, Carmiel, all of Israel

[73] Assignee: State of Israel, Ministry of Defense, Rafael, Armament Development Authority, Haifa, Israel

[21] Appl. No.: 893,777

[22] Filed: Aug. 6, 1986

[51] Int. Cl.[4] ..... B65H 3/08

[52] U.S. Cl. ..... 271/90; 271/249; 271/250; 271/258; 271/265; 271/268; 414/82; 112/306

[58] Field of Search ..... 112/153, 306, 121.15; 271/226, 241, 248, 250, 264, 265, 189, 227, 228, 242, 245, 249, 251, 252, 268, 258, 259, 277, 90, 265, 103; 414/35, 36, 82

[56] References Cited

U.S. PATENT DOCUMENTS

| | | | |
|---|---|---|---|
| 2,384,241 | 9/1945 | Elsner | 271/90 |
| 3,360,262 | 12/1967 | Kekopoulos et al. | 112/306 X |
| 3,378,257 | 4/1968 | Boynton et al. | 271/227 X |
| 4,072,306 | 2/1978 | Idstein | 271/265 X |
| 4,112,860 | 9/1978 | Ellington et al. | 112/121.15 X |
| 4,188,027 | 2/1980 | Naumann | 271/241 |
| 4,531,726 | 7/1985 | Bornstein | 271/268 X |
| 4,577,854 | 3/1986 | Bachmann et al. | 271/241 X |
| 4,623,291 | 11/1986 | Buck | 414/35 X |
| 4,634,107 | 1/1987 | Vandersyde et al. | 271/268 X |
| 4,635,917 | 1/1987 | Granot et al. | 271/18.3 |

FOREIGN PATENT DOCUMENTS

| | | | |
|---|---|---|---|
| 680459 | 8/1939 | Fed. Rep. of Germany | 271/250 |
| 1152909 | 4/1985 | U.S.S.R. | 271/90 |

*Primary Examiner*—Joseph J. Rolla
*Assistant Examiner*—Edward S. Ammeen
*Attorney, Agent, or Firm*—Benjamin J. Barish

[57] ABSTRACT

A sheet feeding apparatus includes an edge aligning device for aligning an edge of individually fed sheets with respect to an underlying table. A tray overlies the table and has an upper sheet-receiving surface for receiving the individually fed sheets. An aligning member mounted to overly the tray includes an aligning wall having a knife edge lightly engageable with the tray. The tray is reciprocated by a reciprocating drive through a forward stroke positioning the tray to receive a sheet on its sheet-receiving surface laterally of the knife edge, and a return stroke moving the sheet-receiving surface towards the knife edge to move the sheet thereon against the knife edge, thereby to align the sheet therewith, and then past the knife edge while further movement of the sheet is arrested by the knife edge, thereby permitting the sheet to drop onto the underlying table.

16 Claims, 12 Drawing Figures

FIG. 5
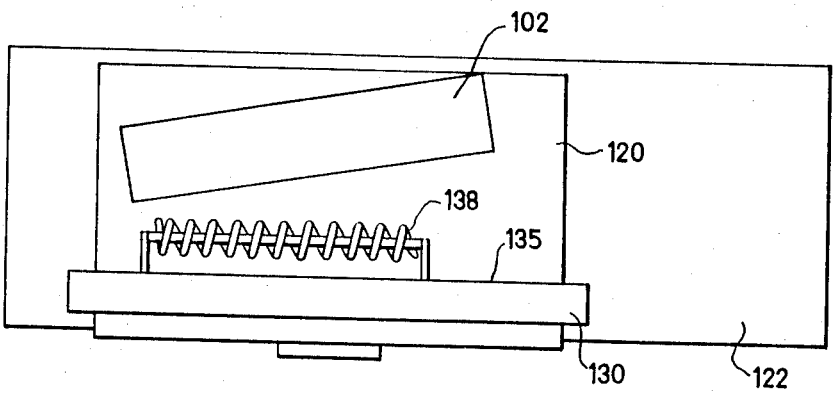
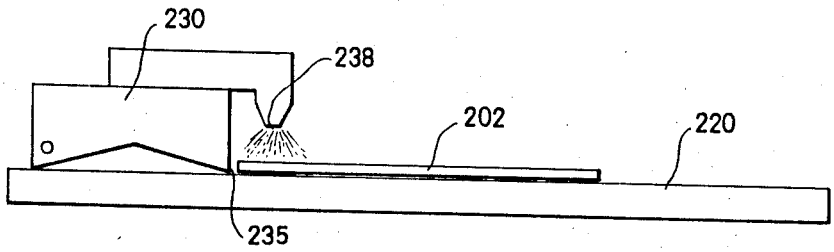
FIG. 6

FIG 7
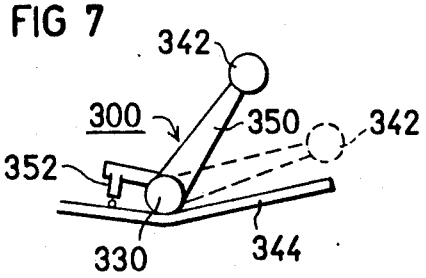
FIG 7a
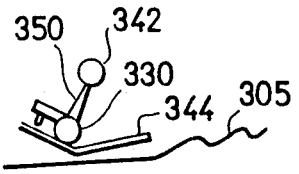
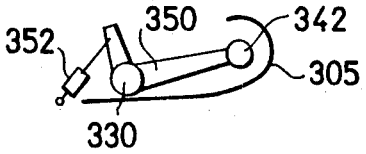
FIG 7b
FIG. 8
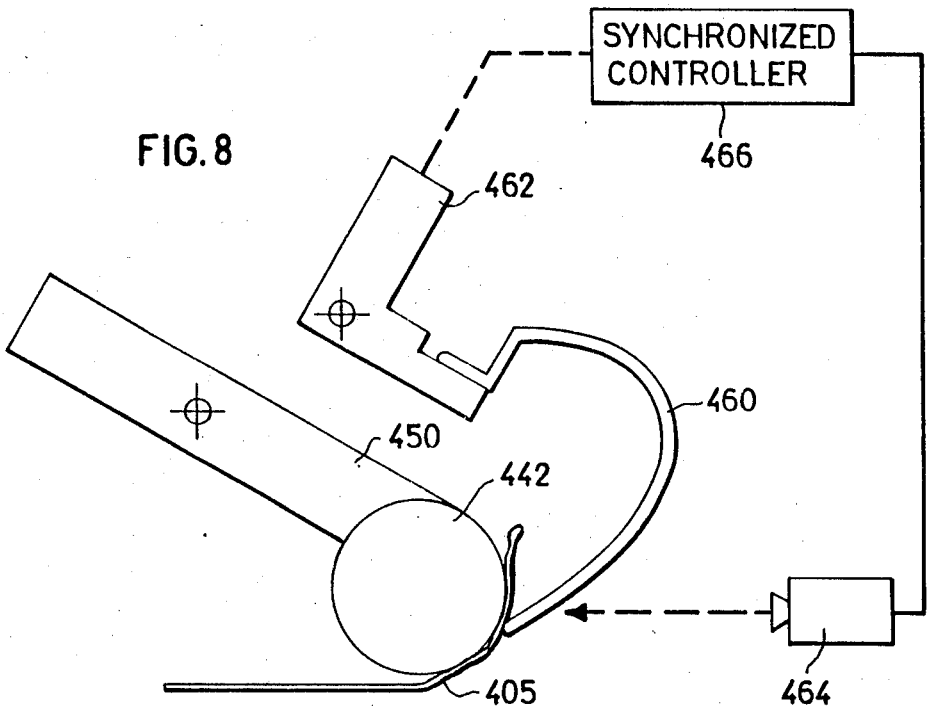

SHEET FEEDING APPARATUS INCLUDING AN EDGE-ALIGNING DEVICE

RELATED APPLICATIONS

The present application is related to copending applications Ser. No. 06/678,585, now U.S. Pat. No. 4,635,917, and Ser. No. 06/802,170, both assigned to the same assignee as the present application.

BACKGROUND OF THE INVENTION

The present invention relates to sheet feeding apparatus, and is particularly directed to an edge aligning device for such apparatus.

The invention is particularly useful in the apparatus for feeding sheets of fabrics, leather, or other limp or porous material, as described in our co-pending U.S. patent application Ser. Nos. 06/678,585 (now U.S. Pat. No. 4,635,917), and 06/802,170. As therein described, the limpness, softness, porosity and roughness of such sheets have imposed very difficult problems for automatically feeding them. The same problems are also involved in precisely aligning the sheets, which is frequently required in automatic feeding apparatus for the garment industry. One operation in the garment industry which is particularly difficult for automation is the "cuff hemming" operation. This operation, which is usually the first step in the production of shirts, involves sewing liners at precise locations on an underlying strip. Protruding loose threads at the end of the liner sheet are particularly troublesome in precisely aligning the liner, e.g., with an aligning end wall, in an automatic manner. At the present time, because of the difficulty in precisely locating the liners on the underlying strip, this operation is usually performed manually and not automatically.

An object of the present invention is to provide improved sheet feeding apparatus particularly useful for feeding sheets of fabric, leather, or similar types of limp materials. Another object of the invention is to provide an edge aligning device for aligning an edge of individually fed sheets in an automatic manner.

SUMMARY OF THE INVENTION

According to a broad aspect of the present invention, there is provided sheet feeding apparatus including an edge aligning device for aligning an edge of individually fed sheets with respect to an underlying table, comprising: a tray overlying the table and having an upper sheet-receiving surface for receiving the individually fed sheets; an aligning member mounted to overly the tray and including an aligning wall having a knife edge lightly engageable with the tray; and a reciprocating drive reciprocating the tray through a forward stroke positioning the tray to receive a sheet on its sheet-receiving surface laterally of the knife edge, and a return stroke moving the sheet-receiving surface towards the knife edge to move the sheet thereon against the knife edge, thereby to align the sheet therewith, and then past the knife edge while further movement of the sheet is arrested by the knife edge, thereby permitting the sheet to drop onto the underlying table.

In the preferred embodiment of the invention described below, the aligning member is pivotably mounted along an axis laterally of the knife edge on the side thereof opposite to the sheet-receiving surface of the tray such that the knife edge is lightly engageable with the tray by gravity.

According to a another feature described below, the aligning device further includes bounce-arresting means for arresting the bounce-back of the sheet when moved against the knife edge during the return stroke of the tray. Preferably, the latter means includes a plurality of rollers constructed and dimensioned so as to permit not only rolling movement but also lateral movement with respect to the aligning edge. However, it is also contemplated to use other bounce-arresting means, such as a rod of helical configuration or a plurality of air-jet nozzles.

According to yet another feature in the described preferred embodiment, the sheet feeding apparatus further comprises a pick-up head for sequentially picking-up sheets from a stack; a transfer mechanism transferring the picked-up sheets carried by the pick-up head to the tray; a gripper member actuatable from an inoperative position to an operative position gripping a picked-up sheet between the gripper member and the pick-up head; a sensor sensing the presence of a picked-up sheet on the pick-up head; and a controller controlled by the sensor to actuate the gripper member to its operative position, and the transfer mechanism to transfer the picked-up sheet to the tray, only when said sensor has sensed the presence of a picked-up sheet on the pick-up head.

It has been found that sheet feeding apparatus constructed in accordance with the foregoing features may be used for feeding, and particularly for edge aligning, sheets of fabric, leather or other similar type materials which heretofor have imposed very considerable difficulties for automatic feeding and aligning.

Further features and advantages of the invention will be apparent from the description below.

BRIEF DESCRIPTION OF THE DRAWINGS

The invention is herein described, by way of example only, with reference to the accompanying drawings, wherein:

FIG. 5 is a top plan view illustrating a variation in the construction of the aligning device at the end of its forward stroke;

FIG. 6 is a side elevational view illustrating a still further variation in the aligning device;

FIGS. 7, 7*a* and 7*b* schematically illustrate the construction and operation of the pick-up head in the sheet feeding apparatus of FIG. 1; and FIG. 8 illustrates an improvement in the pick-up head of FIG. 7.

DESCRIPTION OF PREFERRED EMBODIMENTS

Figure 1:
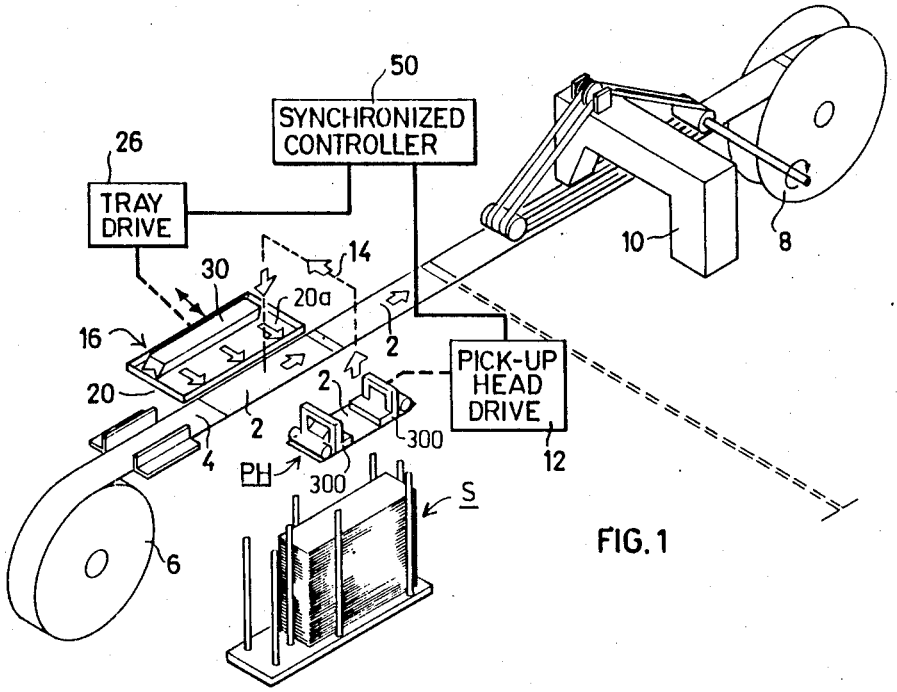
FIG. 1 diagrammatically illustrates one form of sheet feeding apparatus constructed in accordance with the present invention.

The sheet feeding apparatus illustrated in the drawings is particularly useful for "cuff hemming" operations, wherein sheets 2 of a lining material are to be individually picked-up from a stack S by a pick-up head PH and to be precisely placed on a continuous strip 4 moving from a supply reel 6 to a take-up reel 8 and to be sewn to the continuous strip by a sewing head 10. The pick-up head PH sequentially picks-up the sheets 2 from stack S and transfers each sheet, by a transfer mechanism driven by a pick-up head drive, schematically indicated at 12, through the path indicated by arrows 14 to an aligning device, generally designated 16, overlying strip 4. Aligning device 16 aligns the edges of each such sheet before the sheet is dropped by gravity onto strip 4.

Figure 2:
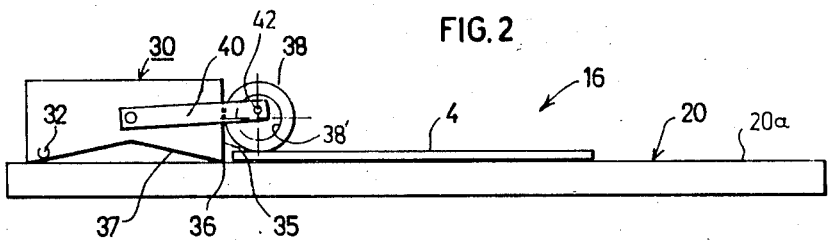
FIG. 2 is an enlarged side elevational view illustrating the edge aligning device in the apparatus of FIG. 1.
Figure 3:
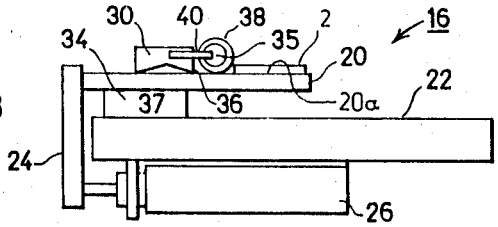
FIGS. 3 and 3*a* are side and top views, respectively, illustrating the edge aligning device of FIG. 2 in extended position at the end of its forward stroke.
Figure 4:
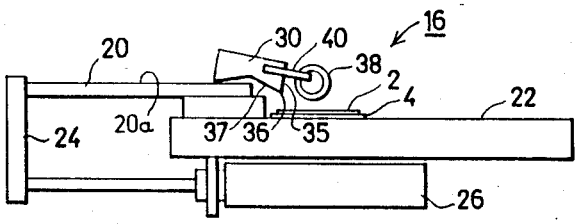
FIGS. 4 and 4*a* are corresponding views illustrating the aligning device in retracted position at the end of its return stroke.
Figure 3A:
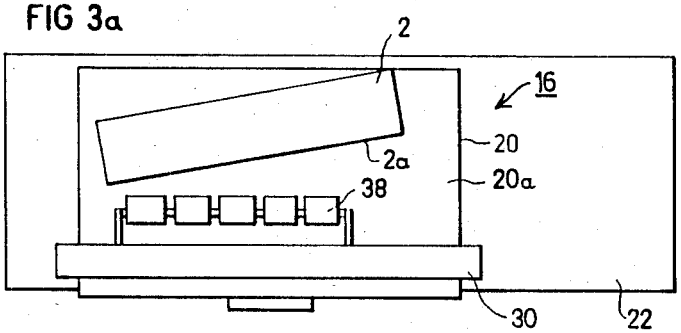
Figure 4A:
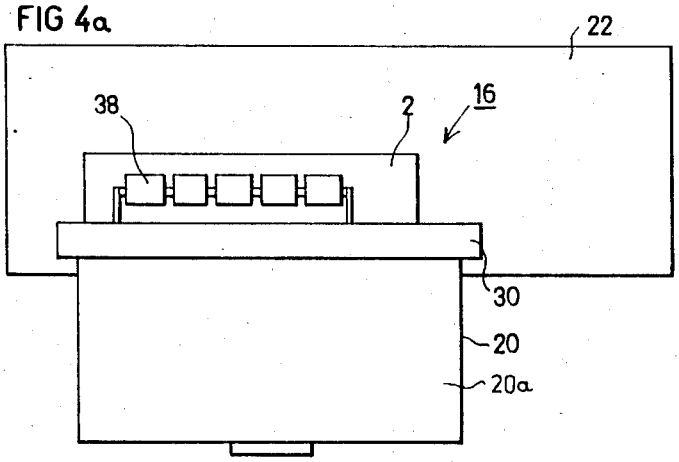

The construction of aligning device 16 is more particularly illustrated in FIGS. 2–4. It includes a tray 20 overlying the table 22 on which strip 4 moves. One side of tray 20 is coupled by coupling member 24 to a piston-cylinder type reciprocating drive 26 mounted to the lower face of table 22. Drive 26 reciprocates table 20 through forward stroke and return strokes; FIGS. 3 and 3*a* illustrate the extended position of table 20 at the end of the forward strokes, and FIGS. 4 and 4*a* illustrate its retracted position at the end of the return strokes.

As particularly seen in FIGS. 3 and 3*a*, one end of tray 20 overlies the continuous strip 4 when the tray is in its extended position at the end of its forward stroke. The lining sheets 2 to be deposited on the continuous strip 4 are received on the upper surface of this end of the tray; this latter surface is thereby called the sheet-receiving surface of the tray and is designated 20*a*. Lining sheet 2 may be deposited by the pick-up head PH (FIG. 1) on surface 20*a* of tray 20 in any skewed position on the tray, as shown in FIG. 3*a*, and it is the function of the aligning device 16 to precisely align edge 2*a* of the lining sheet 2, as shown in FIG. 4*a*, before the lining sheet is dropped onto the continuous strip 4.

For this purpose, the illustrated apparatus includes an aligning member 30 mounted to overlie tray 20 laterally of its sheet-receiving surface 20*a* when the tray is in its fully extended position as illustrated in FIGS. 3 and 3*a*. Aligning member 30 is pivotably mounted at one, as shown at 32 (FIG. 2), to a fixed portion of the apparatus, as shown at 34 (FIG. 3), and includes at its opposite end an aligning wall 35 having a knife edge 36 which is lightly engageable by the weight of member 30 with the upper surface of tray 20 when the tray is in its extended position. The underside of member 30 is formed with a cam surface 37. As will be described more particularly below, cam surface 37 is engaged by the tray 20 during its forward stroke to pivot member 30 to its operative position wherein its knife edge 36 is adapted to engage edge 2*a* (FIG. 3*a*) of the lining sheet 2 during the return stroke of tray 20, to precisely align that edge and thereby to precisely orient the sheet 2 with respect to the continuous strip 4 before the sheet is dropped thereon.

Aligning device 16 further includes a series of rollers 38 coupled by end arms 40 and shaft 42 to aligning member 30. These rollers 38 extend parallel to and laterally of the knife edge 36 of aligning member 30 and serve as bounce-arresting means for arresting the bounce-back or recoil of the lining sheets 2 after they have engaged wall 35 of aligning member 30 formed with knife edge 36, so as to assure that the lining sheets 2 will be precisely located when dropped onto the underlying continuous strip 4.

As shown particularly in FIG. 2, rollers 38 are formed with central bores or passageways 38' of considerably larger size than shaft 42 coupling the rollers to the aligning member 30. Thus, the rollers 38 are permitted not only to roll over the upper surface of tray 20, and any sheet thereon, but also to move in both the vertical and horizontal directions with respect to the tray and sheet thereon. Preferably, rollers 38 are made of metal so as to be relatively heavy.

The illustrated apparatus further includes a synchronized controller, schematically indicated at 50 in FIG. 1, which controls the pick-up head drive 12 and the tray drive 26 to produce the following synchronized operations for sequentially removing the lining sheets 2 from the stack S and depositing them on the continuously moving strip 4:

First, pick-up head PH picks up the top sheet 2 in the stack S and transfers it to the sheet-receiving surface 20*a* of tray 20 while the tray is being driven by its drive 26 through its forward stroke, such that the sheet is deposited on the sheet-receiving surface 20*a* of tray 20 when the tray is in its fully extended position as illustrated in FIGS. 3 and 3*a*. In this position of the tray, the aligning end wall 35 of aligning member 30, and also the rollers 38 coupled to aligning member 30, are both laterally to one side of the deposited sheet, with the knife edge 36 of aligning member 30, and rollers 38, both lightly engaging the tray by their own weight. The actual orientation of the deposited sheet 2 on tray 20 is not critical, as shown in FIG. 3*a* wherein it will be seen that edge 2*a* of sheet 2 is at an angle with respect to the aligning end wall 35 of aligning member 30.

Drive 26 now starts to drive tray 20 through its return stroke. During this return stroke, rollers 38 first engage sheet 2 carried by the tray and roll along the upper surface of the sheet until the sheet engages the aligning end wall 35 of aligning member 30. The movement of the sheet is quite rapid, and the sheet would therefore have a tendency to bounce back from end wall 35; however, this bouncing back of the sheet is arrested by rollers 38, such that edge 2*a* of the sheet becomes exactly aligned with end wall 35 of aligning member 30. As tray 20 continues through its return stroke, the end of the tray moves past knife edge 36 of aligning member 30, at which time sheet 2 drops by gravity onto the underlying continuous strip 4, as shown in FIG. 4.

The above-described cycle is then repeated for the next lining sheet 2 to be deposited on the continuously fed tape 4, the end of tray 20 engaging cam surface 37 of aligning member 30 at the beginning of the next forward stroke to lift the aligning member in position for aligning the next strip deposited on tray 20 at the end of the forward stroke of the tray.

It has been found that knife edge 36, lightly engaging tray 20 by the weight of aligning member 30, maintains continuous contact with the tray during its reciprocatory movements and effectively aligns edge 2*a* of the fed sheet even though the sheet may be of limp fabric and includes loose threads along this edge. It has also been found that rollers 38 permit the fed sheets 2 to move towards the aligning wall 35, by rolling along the upper face of the fed sheet, but effectively arrest the sheet from bouncing back after impacting against the end wall, thereby maintaining the fed sheet with its edge 2*a* precisely aligned with the end wall at the end of the return stroke of tray 20 when the sheet falls on top of strip 2 on table 22.

FIGS. 5 and 5*a* illustrate the use of a rod, preferably of heavy metal, and of helical configuration, generally designated 138, in place of the bounce-arresting rollers 38 in the aligning device of FIGS. 2–4. As in the latter figures, the bounce-arresting helical rod 138 is also coupled to the aligning member, therein designated 130, so as to extend parallel to, but laterally of, the aligning end wall 135 of that member, and is also freely rollable and movable in all directions. Aligning end wall 135 of aligning member 130 is also formed with a knife edge (not shown) corresponding to knife edge 36 described above with respect to aligning member 30. Helical rod 138 rolls over the sheet 102 as it is fed into engagement with aligning end wall 135 by the reciprocation of its tray 120, and arrests the sheet from bouncing-back from the end wall, in the same manner as described above with respect to the FIGS. 1–4 embodiment. The other elements of the aligning device illustrated in FIG. 5 are of the same construction and operate in the same manner as described above with respect to FIGS. 2–4.

FIG. 6 illustrates a still further variation wherein the bounce-arresting means is in the form of a plurality of air-jet nozzles 238 extending parallel to and laterally of the aligning end wall 235 of aligning member 230; the air jets are effective to permit sheet 202 to move against aligning end wall 235 but apply a light pressure, similar to that of rollers 38 in FIGS. 2–4 and helical rod 138 in FIG. 5, on the upper face of the fed sheet 202 to prevent its bounce-back from end wall 235.

Pickup-head PH in FIG. 1 includes two pick-up devices, each generally designated 300, acting on the two opposite ends of the top sheet 2 in the stack S as it is picked up by the pick-up head. FIG. 7 illustrates the structure of each of the pick-up devices 300, which is the same as described in our U.S. patent application Ser. No. 06/802,170; and FIG. 7*a* and 7*b* illustrate the operation of the pick-up device. FIG. 8 illustrates a modification in the construction of the pick-up device particularly useful for this application in order to increase its reliability when feeding fabric sheets having a very high tendency of entanglement between sheets.

Thus, the pick-up device illustrated in FIG. 7 (which as mentioned above is the same as described in U.S. patent application Ser. No. 06/802,170) is generally designated 300 and includes a nozzle 330, a cylindrical rod 342 and a shield 344. Rod 342 is carried at the end of an arm 350 which is movable by a piston-cylinder drive 352 either to an initial, inoperative position shown by full lines in FIG. 7, or to an operative position shown by phantom lines in FIG. 7. In the inoperative position of rod 342, it has no significant influence on the air streams from nozzle 330 so that such air streams produce a fluttering action on the top sheet 305 of the stack as shown in FIG. 7*a*. This is the position of rod 342 when the pick-up head is distant from the top sheet; the increase fluttering action better separates the edges of the top sheet from the underlying sheet as shown in FIG. 7*a*. However, as or after the pick-up head engages the top sheet 305, drive 352 is actuated to move rod 342 to its operative position (FIG. 7*b*), whereby its presence in the air stream increases the forces tending to curl the outer edges of the top sheet 305 of the stack around the rod. Further details of the construction and operation of the pick-up device illustrated in FIGS. 7, 7*a* and 7*b*, are set forth in the above-cited U.S. patent application Ser. No. 06/802,170.

FIG. 8 illustrates an improvement wherein the pick-up device is provided with a gripper member 460 which cooperates with rod 442 (corresponding to rod 342 in FIGS. 7, 7*a*, 7*b*) carried at the end of an arm 450 to positively grip the curled end of the picked-up sheet 405 between gripper member 460 and rod 442. As shown in FIG. 8, gripper member 460 is in the form of a spring finger secured at one end to an actuator 462 which, when actuated, moves spring finger 460 to the position illustrated in FIG. 8 in engagement with the curled end of the picked-up sheet 405. Actuator 462 is controlled by a photocell sensor 464, which senses the presence of a picked-up sheet on rod 442 of the pick-up head. If such a sheet is sensed, sensor 464 controls a synchronized controller 466 (which may be part of controller 50 in FIG. 1) to actuate the actuator 462 and thereby to move spring finger 460 into engagement with the curled end of the picked-up sheet 405, thereby positively gripping the sheet so as to assure its successful transfer to the aligning device 16 described above with respect to FIG. 1. However, if sensor 464 fails to sense the presence of a picked-up sheet, it so signals controller 466 and causes the latter not to actuate spring finger 460, and also not to actuate the pick-up head drive 12 to transfer the head to the aligning device 16, but rather to cause the pick-up head to merely repeat the pick-up operation for picking-up the top sheet in the stack.

While the invention has been described with respect to one preferred embodiment, it will be appreciated that many other variations, modifications and applications of the invention may be made.

What is claimed is:

1. Sheet feeding apparatus including an edge aligning device for aligning an edge of individually fed sheets with respect to an underlying table, comprising:

a tray overlying said table and having an upper sheet-receiving surface for receiving the individually fed sheets;

an aligning member mounted to overly said tray and including an aligning wall having a knife edge lightly engageable with said tray;

and a reciprocating drive reciprocating said tray through a forward stroke positioning the tray to receive a sheet on its sheet-receiving surface laterally of said knife edge, and a return stroke moving the sheet-receiving surface towards said knife edge to move the sheet thereon against said knife edge, thereby to align the sheet therewith, and then past said knife edge while further movement of the sheet is arrested by said knife edge, thereby permitting the sheet to drop onto the underlying table.

2. The apparatus according to claim 1, wherein said aligning member is pivotably mounted along an axis laterally of said knife edge on the side thereof opposite to the sheet-receiving surface of said tray such that its knife edge is lightly engageable with the tray by gravity.

3. Sheet feeding apparatus according to claim 2, wherein said pivotable aligning member is formed with a cam surface on its underface engageable with the tray at an early portion of its forward stroke to lift the knife edge of the aligning member to overlie the tray.

4. The apparatus according to claim 2, wherein said aligning member further includes bounce-arresting means for arresting the bounce-back of the sheet when moved against said knife edge during the return stroke of the tray.

5. Sheet feeding apparatus according to claim 4, wherein said bounce-arresting means comprises rolling means coupled to said aligning member on the side of the aligning wall thereof facing said sheet-receiving surface of the tray.

6. The apparatus according to claim 5, wherein said rolling means is coupled to said aligning member by a shaft pivotably mounted to said aligning member and passing through an opening in said rolling means dimensioned to permit not only rolling movement of the rolling means, but also lateral movement thereof with respect to the aligning member.

7. The apparatus according to claim 5, wherein said rolling means is metal so as to be relatively heavy.

8. The apparatus according to claim 5, wherein said rolling means comprises a plural spaced rollers extending parallel to and laterally of the aligning wall of said aligning member.

9. The apparatus according to claim 5, wherein said rolling means is in the form of a rod of helical configuration extending parallel to and laterally of the aligning wall of said aligning member.

10. The apparatus according to claim 4, wherein said bounce-arresting means comprises a plurality of spaced air-jet nozzles extending parallel to and laterally of the aligning wall of the aligning member.

11. The apparatus according to claim 1, wherein said apparatus further comprises a pick-up head for sequentially picking-up sheets from a stack;

a transfer mechanism transferring the picked-up sheets carried by the pick-up head to said tray;

a gripper member actuatable from an inoperative position to an operative position gripping a picked-up sheet between the gripper member and the pick-up head;

a sensor sensing the presence of a picked-up sheet on the pick-up head;

and a controller controlled by said sensor to actuate said gripper member to its operative position, and said transfer mechanism to transfer the picked-up sheet to said tray, only when said sensor has sensed the presence of a picked-up sheet on the pick-up head.

12. Sheet feeding apparatus including an edge aligning device for aligning an edge of individually fed sheets with respect to an underlying table, comprising:

a tray overlying said table and having an upper sheet-receiving surface for receiving the individually fed sheets;

an aligning member mounted to overly said tray and including an aligning wall;

bounce-arresting means comprising rolling means coupled to said aligning member on the side of the aligning wall thereof facing said sheet-receiving surface of the tray for arresting the bounce-back of the sheet when moved against said aligning wall;

and a reciprocating drive reciprocating said tray through a forward stroke positioning the tray to receive a sheet on its sheet-receiving surface laterally of said aligning wall, and a return stroke moving the sheet-receiving surface towards and then past said aligning wall to move the sheet thereon against said aligning wall, and then to drop onto the underlying table.

13. The apparatus according to claim 12, wherein said rolling means is coupled to said aligning member by a shaft pivotably mounted to said aligning member and passing through an opening in said rolling means dimensioned to permit not only rolling movement of the rolling means, but also lateral movement thereof with respect to the aligning member.

14. The apparatus according to claim 12, wherein said rolling means comprises a plurality of spaced rollers extending parallel to and laterally of the aligning wall of said aligning member.

15. The apparatus according to claim 12, wherein said rolling means is in the form of a rod of helical configuration extending parallel to and laterally of the aligning wall of said aligning member.

16. Sheet feeding apparatus including an edge aligning device for aligning an edge of individually fed sheets with respect to an underlying table, comprising:

a tray overlying said table and having an upper sheet-receiving surface for receiving the individually fed sheets;

an aligning member mounted to overly said tray and including an aligning wall;

bounce-arresting means comprising a plurality of spaced air-jet nozzles extending parallel to and laterally of the aligning wall of the aligning member for arresting the bounce-back of the sheet when moved against said aligning wall;

and a reciprocating drive reciprocating said tray through a forward stroke positioning the tray to receive a sheet on its sheet-receiving surface laterally of said aligning wall, and return stroke moving the sheet-receiving surface towards and then past said aligning wall to move the sheet thereon against said aligning wall, and then to drop onto the underlying table.

* * * * *